US007389066B2

(12) United States Patent
Portig et al.

(10) Patent No.: US 7,389,066 B2
(45) Date of Patent: Jun. 17, 2008

(54) VARIABLE FORCE BIASING MECHANISM AND ELECTRICAL CONNECTION

(75) Inventors: Harald Portig, Versailles, KY (US); Larry Steven Foster, Lexington, KY (US); Benjamin Alan Askren, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/834,390

(22) Filed: Aug. 6, 2007

(65) Prior Publication Data

US 2007/0269231 A1 Nov. 22, 2007

Related U.S. Application Data

(62) Division of application No. 11/438,873, filed on May 23, 2006, now Pat. No. 7,286,783, which is a division of application No. 10/804,691, filed on Mar. 19, 2004, now Pat. No. 7,082,275.

(51) Int. Cl.
*G03G 15/00* (2006.01)

(52) U.S. Cl. ..... 399/111

(58) Field of Classification Search ..... 399/90, 399/109, 110, 111
See application file for complete search history.

(56) References Cited

U.S. PATENT DOCUMENTS

| | | | | |
|---|---|---|---|---|
| 2,229,009 | A * | 1/1941 | Berry | 324/429 |
| 4,453,791 | A * | 6/1984 | Ledbetter | 439/504 |
| 4,826,457 | A * | 5/1989 | Varatta | 439/755 |
| 6,185,390 | B1 * | 2/2001 | Higeta et al. | 399/90 |
| 6,400,914 | B1 * | 6/2002 | Noda et al. | 399/90 |

* cited by examiner

*Primary Examiner*—Ryan Gleitz
(74) *Attorney, Agent, or Firm*—David D. Kalish

(57) ABSTRACT

A biasing mechanism in an image forming apparatus exerts a variable force on a removable cartridge unit to generate a nip force between a roller in the cartridge unit and another roller. A pivot member is fixed to the apparatus housing. An arm is pivotally mounted in the housing about the pivot member, with the arm in contact with a protrusion on the cartridge unit. A force generating member is mounted in the housing and contacts the arm so as to urge the arm to pivot about the pivot member and press against the cartridge unit. The resulting force exerted on the cartridge unit by the arm varies according to the point of contact between the cartridge unit and the arm. In some embodiments, the arm and the cartridge unit protrusion are electrically conductive, and an electrical contact is established as the arm is pressed against the protrusion.

20 Claims, 4 Drawing Sheets

VARIABLE FORCE BIASING MECHANISM AND ELECTRICAL CONNECTION

RELATED APPLICATIONS

This application is a divisional application that claims priority from co-pending U.S. patent application Ser. No. 11/438,873 filed on May 23, 2006, which is a divisional application that claims priority from U.S. Pat. No. 7,082,275 filed March 19, 2004.

BACKGROUND

The present invention relates generally to the field of image forming and in particular to a variable force biasing mechanism and an electrical connection for a removable cartridge unit in an image forming apparatus.

The electrophotographic image forming process is well known in the art. A photoconductive surface, such as a drum, roller, or belt, is uniformly charged to a first voltage level. A latent image is then formed on the photoconductive surface by incident optical energy, such as a laser beam. The latent image is developed by applying toner to the photoconductive surface. The toner is typically applied by a developer roller, the surface of which is charged to a second voltage, with toner electrostatically adhered thereto. The toner is electrostatically transferred from the developer roller to the latent image on the photoconductive surface by the voltage difference between the developer roller surface and the latent image area on the photoconductive surface.

Critical factors in the accurate development of latent images are the force applied along the contact between the developer roller and the photoconductive surface, known in the art as the nip force, and the uniformity of the nip force along the nip or contact area. Among other factors, the optimal nip force is determined by properties of the toner. As the state of the art in toner composition advances, the optimal nip force between the developer roller and photoconductive surface, for a given toner formulation, may change.

The nip force is typically controlled by housing the photoconductive surface, such as a photoconductive drum, and the developer roller in a common replaceable cartridge unit, with the nip force controlled within the cartridge unit by low rate springs. The nip force adjustment is accomplished by altering the low rate springs within the cartridge, so that new cartridges, containing the latest formulation of toner, can be installed in existing machines and function at the latest desired nip force.

In addition to control of the nip force, a recurring challenge in the design of removable cartridge units is the provision of electrical contacts for biasing the photoconductive drum and developer roller surfaces to their required voltages, and in grounding these elements. These contacts should provide reliable electrical connectivity, but exert minimal influence on the carefully controlled nip force. Additionally, electrical contacts may be necessary for a doctor blade and/or toner-adder roller, and possibly characterization electronic circuits.

A recent advance in the design of electrophotographic image forming devices separates the developer roller and the PC drum into distinct removable cartridge units. A removable developer unit stores fresh toner of one color, and includes a developer roller, a toner-adder roller, doctor member and three agitating paddles. A removable cleaner unit contains a photoconductive drum, a charge roller, a toner cleaner unit, and a waste toner auger. Mechanical hardware in the machine housing urges the developer unit against the cleaner unit, generating a nip force between the developer roller and the photoconductive drum. However, since this hardware resides in the machine, it is difficult to adjust the nip force to different values for different developer units.

SUMMARY

The present invention relates to an image forming apparatus having a housing and including a cartridge unit removably mounted in the housing. In particular, the image forming apparatus includes a pivot member fixed to the housing. An arm is pivotally mounted in the housing about the pivot member, with the arm in contact with the cartridge unit. A force generating member is mounted in the housing and contacts the arm so as to urge the arm to pivot about the pivot member and press against the cartridge unit. The resulting force exerted on the cartridge unit by the arm varies according to the point of contact between said cartridge unit and the arm. In some embodiments, the arm and its contact point on the cartridge unit are electrically conductive, and establish an electrical contact.

In another aspect, the present invention relates to a method of controlling the force exerted on different removable cartridge units by an image forming apparatus. The method includes providing at least one arm pivotally mounted in the image forming apparatus about a pivot point and biased by a force generating member into contact with a removable cartridge unit having at least one protrusion, where the arm includes a contact member having a longitudinal extent and where the protrusion contacts the arm along the contact member. The method includes positioning a first protrusion on a first removable cartridge unit to contact the contact member at a first longitudinal position, the arm thereby exerting a first force on the first cartridge unit. The method also includes positioning a second protrusion on a second removable cartridge unit to contact the contact member at a second longitudinal position different from the first longitudinal position, the arm thereby exerting a second force on the second cartridge unit different from the first force. In some embodiments, the arm and the protrusion are electrically conductive, and establish an electrical contact.

In yet another aspect, the present invention relates to an image forming apparatus including a housing that includes two fixed pivot points. The image forming apparatus also includes two arms, each pivotally mounted about a pivot point, each arm including a force receiving member and a contact member having a longitudinal extent. The image forming apparatus further includes two force generating members, each exerting a first force at a position on the force receiving member of a different arm, biasing the arm to pivot about a pivot point. The image forming apparatus additionally includes at least one removable cartridge unit housing a first roller and having two protrusions, each of which contacts the contact member of a different arm along the longitudinal extent thereof such that the arm exerts a second force on the cartridge unit through the protrusion. In some embodiments, the arm and the protrusion are electrically conductive, and establish an electrical contact.

DETAILED DESCRIPTION OF THE INVENTION

The present invention is described herein with respect to an image forming apparatus having two separate removable cartridge units for each image forming station, although it is not limited to such an application. In this embodiment, one removable cartridge unit includes a photoconductive drum (PC drum), which is uniformly charged to a first voltage, a latent image formed thereon by irradiation by a laser, which latent image is developed by the application of toner and the developed image transferred to a media sheet or intermediate transport belt. A second removable cartridge includes a developer roller operative to apply toner to the PC drum in the first removable cartridge unit. The cartridge unit containing the developer roller may additionally include a reservoir of toner, and various rollers and other mechanical systems for stirring the toner and transporting it to the developer roller.

When the image forming apparatus is in an operative condition, one or the other of the removable cartridge units may be rigidly fixed within the housing of the image forming apparatus. By use of the variable-force biasing mechanism of the present invention, the non-fixed cartridge unit is pressed against the fixed cartridge unit to develop a nip force between the developer roller and the PC drum. For simplicity of explanation, the following description will assume that the present invention applies an urging force to a cartridge unit containing a developer roller (which in turn generates a nip force as it presses against a PC drum), although those of skill in the art will readily recognize that the present invention may be advantageously applied to the cartridge unit containing the PC drum, either in lieu of or in addition to the embodiment described.

Figure 1:
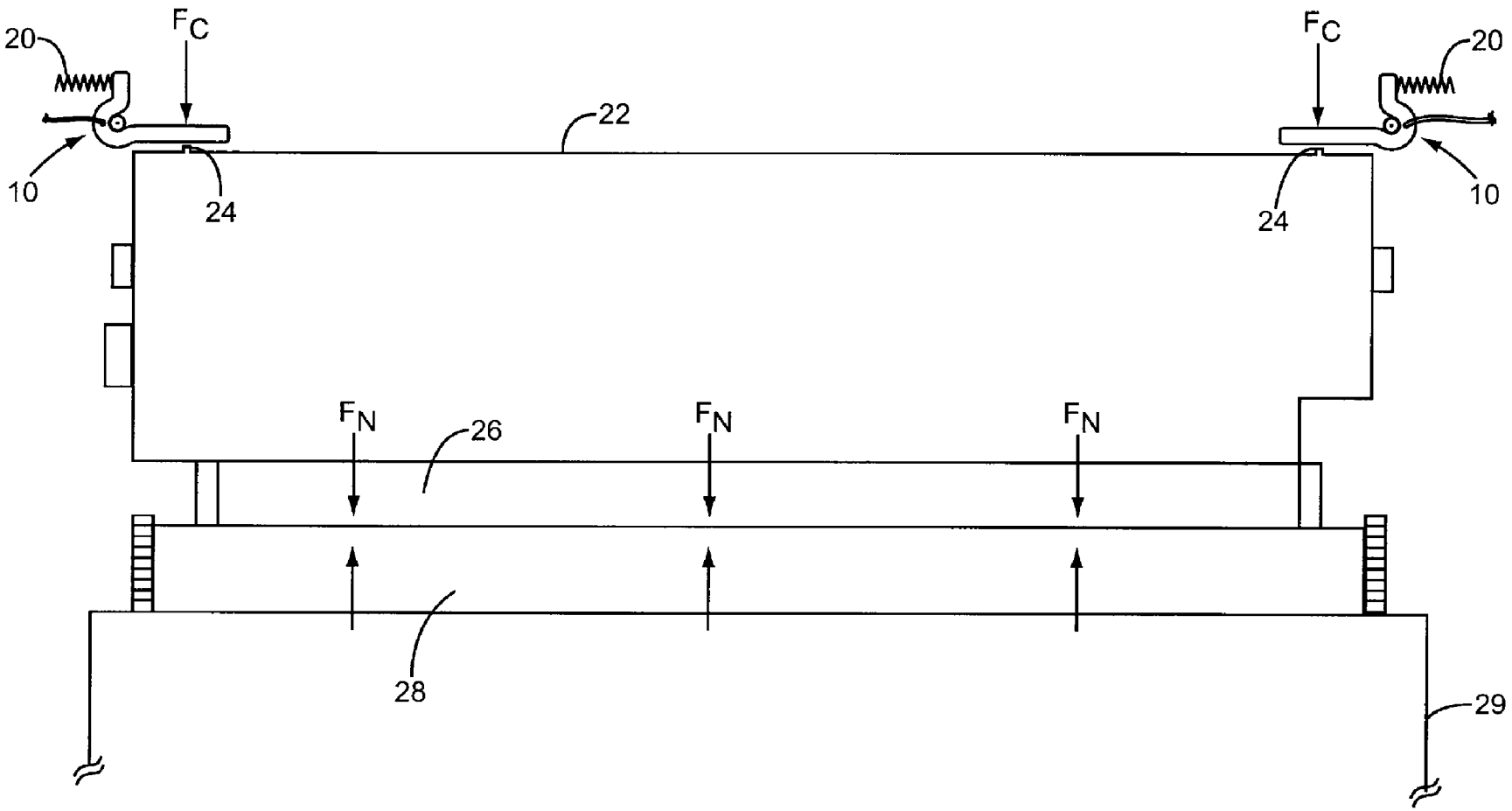
FIG. 1 is a top view of a functional representation of the biasing mechanism of the present invention, and two removable cartridge units.

FIG. 1 depicts one embodiment of a variable-force biasing mechanism 10 according to the present invention (shown in greater detail in FIG. 2) in an operative condition, with a removable cartridge unit 22 installed within the housing of an image forming apparatus (not shown). In this embodiment, the removable cartridge unit 22 includes a partially exposed developer roller 26. The developer roller 26 is in contact along the longitudinal surface thereof with a PC drum 28 housed in, and partially exposed from, a second removable cartridge unit 29. A nip force $F_N$ is developed between the developer roller 26 and the PC drum 28 along the common surface thereof, as indicated by force vectors in FIG. 1, by action of the biasing mechanisms 10.

The action of the biasing mechanism 10 is described with reference to FIG. 2. Biasing mechanism 10 comprises a pivoting arm 11 pivotally disposed about a pivoting member 18 and acted upon by a force-generating member 20. The pivoting arm 11 may be formed of metal, plastic, composites, or any appropriate material. In some embodiments described herein, the pivoting arm 11 is electrically conductive, and biased to a particular voltage by a wire 13 attached at electrical connection 15. However, in general, the pivoting arm 11 need not be electrically conductive, and the wire 13 and electrical connection 15 may be omitted when electrical connectivity through the biasing mechanism 10 is not required or desired.

The pivoting arm 11 includes a bias force receiving member 12, and a contact member 14 having a longitudinal extent and disposed along one edge of the removable cartridge unit 22 when the latter is installed in the image forming apparatus. The force receiving member 12 receives a biasing force from the force generating member 20, which in the embodiment of FIG. 2, is a spring in compression. The force of the spring 20 induces a counter-clockwise moment (in the configuration depicted in FIG. 2) in the pivoting arm 11 about pivot member 18, which is rigidly affixed to the image forming apparatus housing. The counter-clockwise moment urges the contact member 14 into contact with the nearest portion of the removable cartridge unit 22.

A raised protrusion 24 is formed at a predetermined location on the surface of the removable cartridge unit 22 adjacent the contact member 14. Contact between the pivoting arm 11 and the cartridge unit 22 is limited to the contact between the protrusion 24 and the contact member 14. The protrusion 24 may be located at any point along the side of the removable cartridge unit 22 that is within the longitudinal extent of the contact member 14. For example, dotted-line elements 24' and 24" depict alternative representative locations for the protrusion 24. In the embodiments of the present invention in which the pivoting arm 11 is electrically conductive and biased to a voltage, the protrusion 24 is also electrically conductive, and an electrical contact is established by the contact member 14 pressing against the protrusion 24. However, in general, the protrusion 24 need not be electrically conductive.

The transmission of force to the removable cartridge unit 22 by the biasing mechanism 10 is described with reference to the free body diagram of the pivoting arm 11 depicted in FIG. 3. The spring 20 generates a force $F_S$ on the force-receiving member 12, generating a torque in the counter-clockwise direction about the pivot center 16. For the purposes of the current description, the force $F_S$ may be viewed as applied to a point at the center of the contact area between spring 20 and force-receiving member 12. In this case, the counter-clockwise torque induced on the pivot arm 11 has a magnitude of $F_S \times d_1$, where $d_1$ is the distance from the pivot point 16 to the point of application of the force $F_S$. In static equilibrium, this torque is countered by an equal and opposite, i.e., clockwise, torque generated at the point of contact between the protrusion 24 and the contact member 14, denoted in FIG. 3 as $F_C$ (as depicted from the point of view of the pivot arm 11—in operation, the pivot arm 11 exerts the force $F_C$ on the protrusion 24, in the opposite direction as that depicted in FIG. 3). The magnitude of this clockwise torque is $F_C \times d_2$, where $d_2$ is the distance from the pivot point 16 to the protrusion 24 (under the simplifying assumption that the protrusion 24 contacts the contact member 14 at a point). From this relationship, $$F_S \times d_1 = F_C \times d_2$$

or $$F_C = F_S \times \frac{d_1}{d_2}$$

Hence, the force $F_C$ urging the cartridge unit 22 against a cartridge unit 29 is inversely proportional to $d_2$, the distance of the protrusion 24 from the pivot point 16. That is, referring to FIG. 2, protrusion 24" would generate a stronger nip force than would protrusion 24'. In one embodiment, wherein the contact member 14 has an effective longitudinal extent of approximately 16 mm, a force ranging from about 45% to about 150% of the spring 20 force $F_S$ may be applied to the removable cartridge unit 22 by the selective location of the protrusion 24 along the contact member 14.

Figure 4:
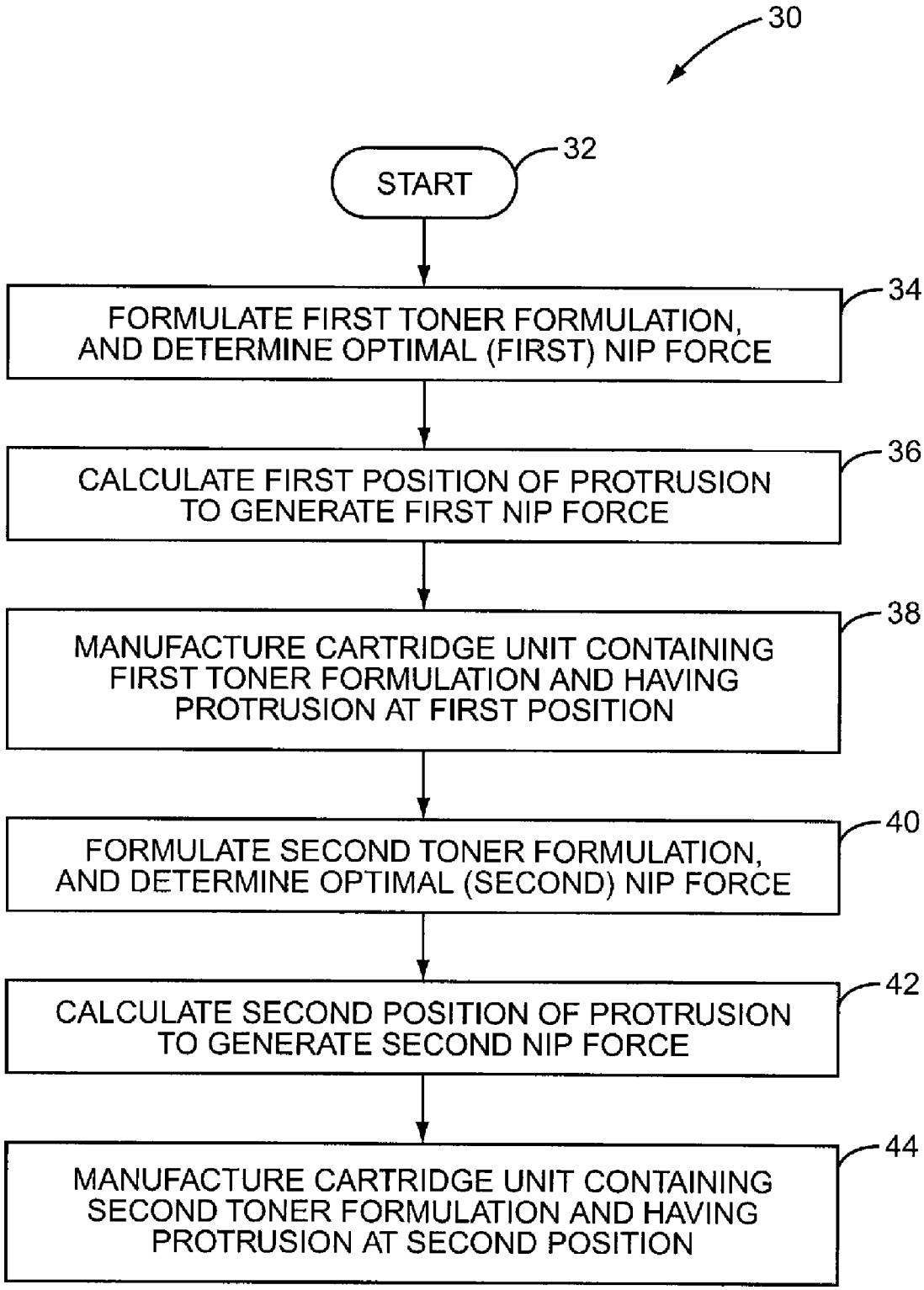
FIG. 4 is a flow diagram of a method of altering the nip force as a toner formulation is changed.

The present invention is particularly suited to adjusting the nip force between the developer roller 26 and PC drum 28 in an image forming apparatus as the toner formulation changes. A method for adjusting the nip force is depicted in flow diagram form in FIG. 4, beginning at block 32. A first toner formulation is generated, and the optimal nip force for that toner formulation (the first nip force) is determined at block 34. A first position for protrusions 24 in a developer cartridge unit 22 is calculated, at step 36, which will generate the first nip force when the cartridge unit 22 is operatively installed in the image forming apparatus. The developer cartridge unit is then manufactured at step 38, containing toner of the first toner formulation and having protrusions 24 at the first position. This model of developer cartridge unit 22 may then be used in all image forming devices of the appropriate model.

A second toner formulation may then be developed, the second toner formulation perhaps offering some benefit over the first toner formulation. The optimal nip force for the second toner formulation (the second force) is determined at step 40. At step 42, assuming the required second force is different than the first force (that required by the first toner formulation), a second position for protrusions 24 is calculated that will generate the second force when the developer cartridge unit 22 is operatively installed in an image forming apparatus. The developer cartridge 22 is then manufactured at step 44, containing toner of the second toner formulation and having protrusions 24 at the second position. This model of developer cartridge unit 22 may then replace the first model of cartridge units 22 in some or all image forming devices of the appropriate model. In this manner, either the first or second toner formulation may be utilized by simply inserting the appropriate cartridge unit 22, and the appropriate nip force for the toner contained therein is applied between the developer roller 26 and PC drum 28, without requiring any adjustment, calibration, or alteration of the image forming apparatus.

Figure 2:
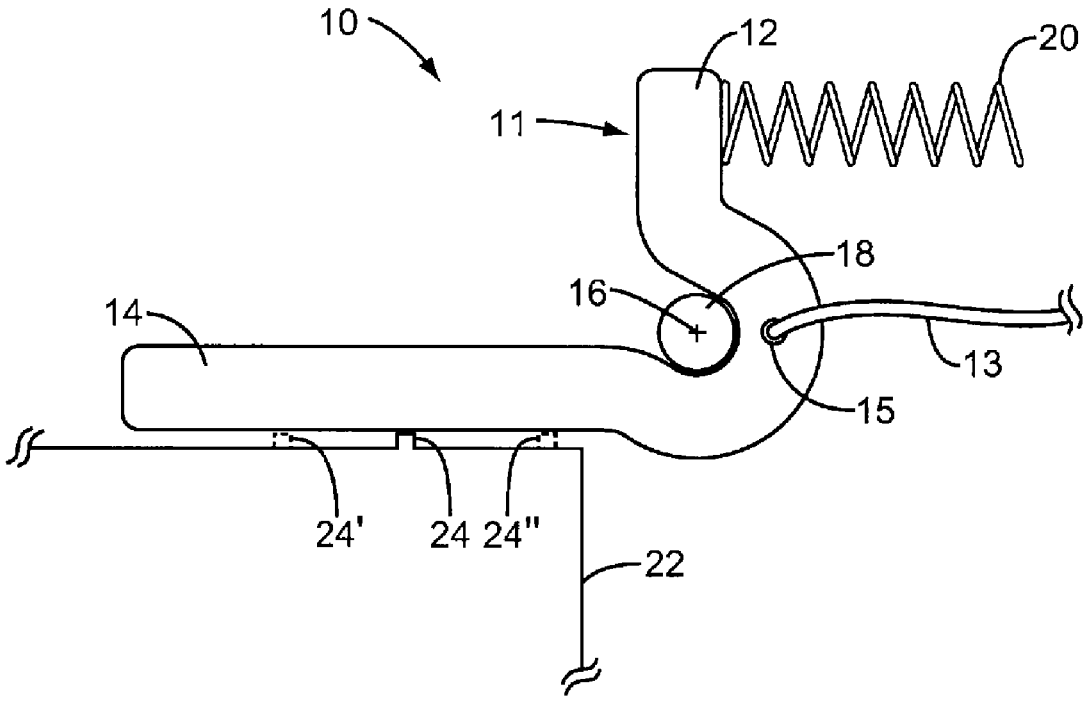
FIG. 2 is a biasing mechanism according to one embodiment of the present invention.
Figure 3:
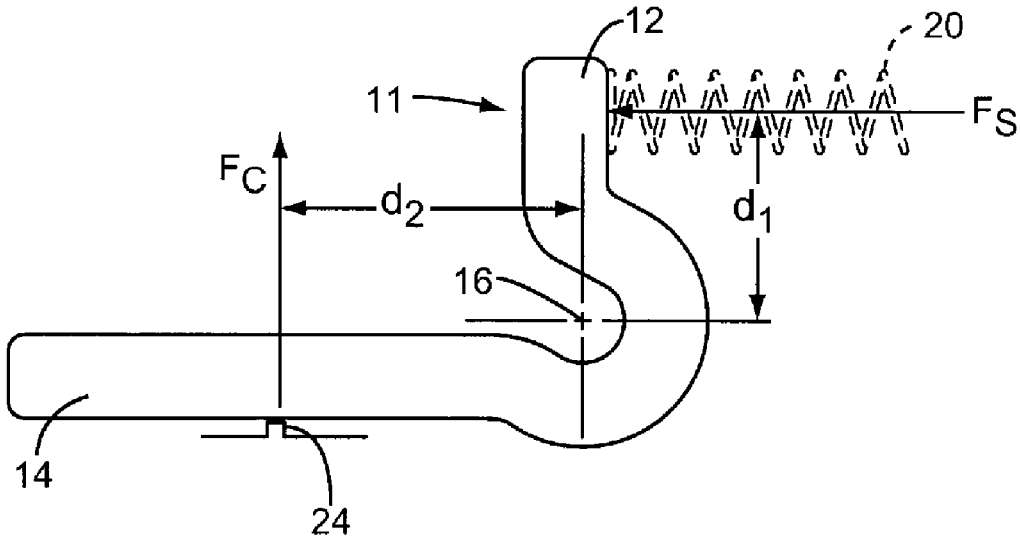
FIG. 3 is a free body diagram of one biasing mechanism, depicting forces acting thereon.
Figure 5A:
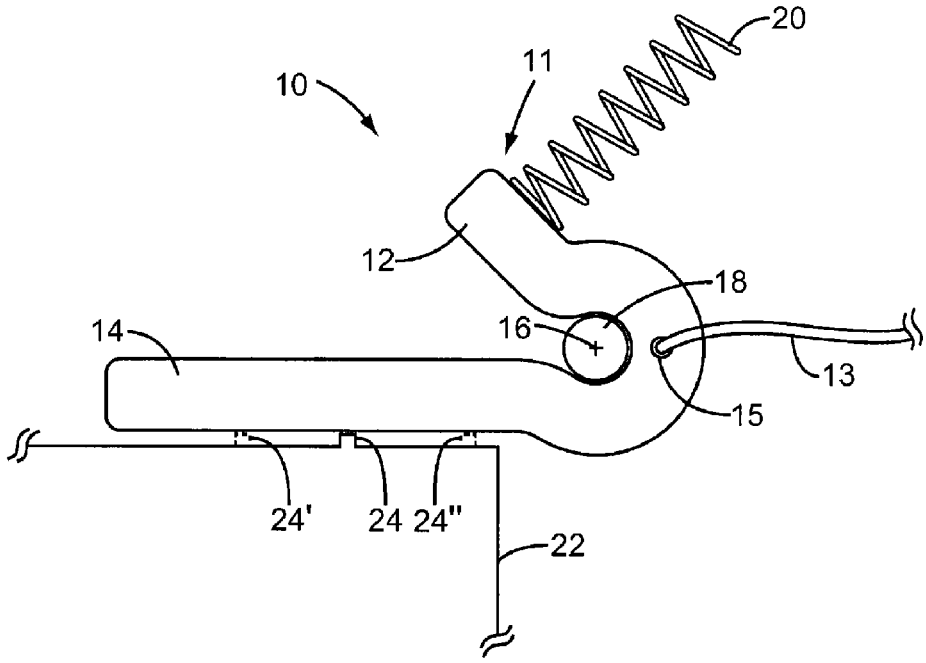
FIGS. 5A and 5B are biasing mechanisms according to further embodiments of the present invention.
Figure 5B:
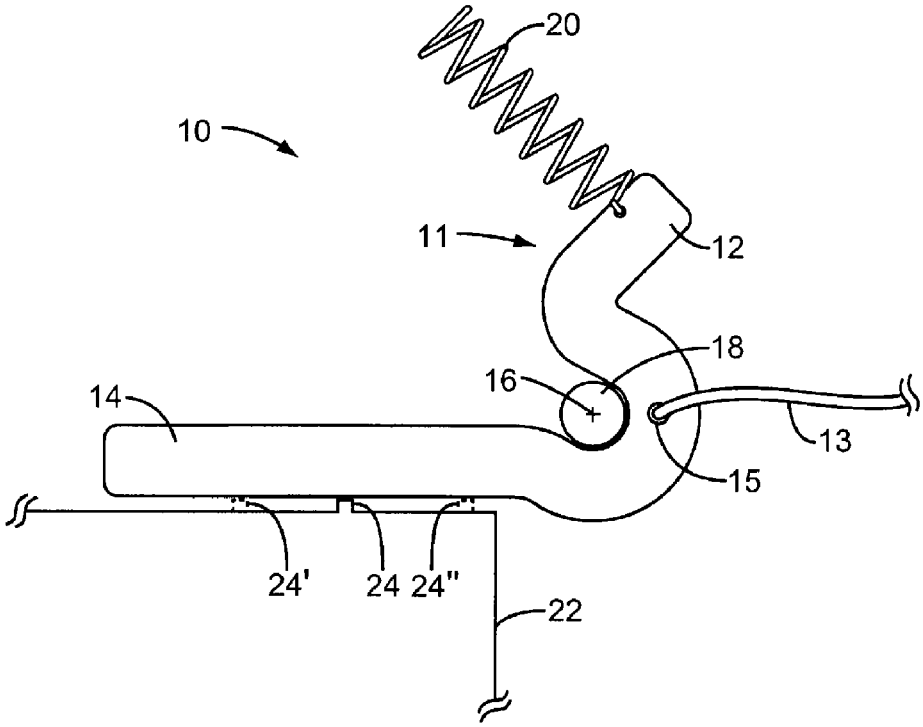

The pivoting arm 11 is depicted in FIGS. 1, 2 and 3 in a generally "L" shaped configuration, with the force receiving member 12 and contact member 14 extending from the pivot point 16 at a generally right angle with respect to each other. The present invention is not limited to this configuration. For example, FIG. 5A depicts an electrical contact 10 wherein the force receiving member 12 and contact member 14 form an acute angle. As another example, FIG. 5A depicts an electrical contact 10 wherein the force receiving member 12 and contact member 14 form an obtuse angle. Additionally, the force producing member 20 in FIG. 5B is a spring in tension. The various relative shapes, sizes, and placement of the elements of the biasing mechanism 10 of the present invention may be varied as required for a particular implementation. All such embodiments fall within the scope of the present invention, which is defined by the claims and not limited to any particular disclosed embodiment thereof.

Although described herein with respect to an image forming apparatus utilizing a PC drum and developer roller in separate cartridge units, the present invention is not limited to this application. As those of skill in the art will readily recognize, the biasing mechanism of the present invention is mounted in a housing, and applies a variable force against a separate unit or member. That unit may comprise a removable cartridge housing a PC drum, a developer roller, or both (or neither). In a cartridge unit housing both a PC drum and developer roller, the present invention may control the nip force between the two by applying a bias force to the cartridge unit that is mechanically translated within the cartridge unit to a nip force. Alternatively, it may urge the PC drum of a removable cartridge unit against an intermediate transfer belt or media sheet, wherein a precise nip force is required to transfer a developed image from the PC drum to the belt or sheet. Those of skill in the art will recognize various other applications of the present invention wherein providing a variable bias force is advantageous, within the broad practice of the present invention as claimed herein.

Additionally, although FIG. 1 depicts two biasing mechanisms 10 in contact with the removable cartridge unit 22, the present invention is not so limited. For example, a single biasing mechanism 10, positioned in the center of the removable cartridge unit 22 and oriented at right angles to the biasing mechanisms 10 as displayed in FIG. 1 (e.g., into or out of the plane of the image of FIG. 1) may be sufficient. Alternatively, a plurality of biasing mechanisms 10 may be needed, arrayed along the surface of the removable cartridge unit 22 as necessary, to provide sufficient bias force for a given application. Note that positioning the biasing mechanisms 10 in the body of the image forming apparatus decreases the cost of the removable cartridge unit 22, which need not include the springs, levers, and the like necessary to separately generate the proper nip force. This cost benefit over prior art biasing methods is multiplied as the number of biasing mechanisms 10 increase.

According to some embodiments of the present invention, in addition to applying a variable force to a removable cartridge unit, the biasing mechanism serves as an electrical contact that provides electrical connectivity to the cartridge unit. This may be advantageous, for example, to charge the surface of a developer roller (or PC drum) in the removable cartridge unit, and/or to provide a ground connection. In these embodiments, as depicted in FIG. 2, the pivoting arm 11 is electrically conductive, and may be biased to a particular voltage by an electrical contact 15 with wire 13, which is connected to control electronics (not shown). Note that the electrical contact 15 may be located anywhere on the pivoting arm 11, as necessary or convenient for a particular application. Alternatively, electrical connectivity may be established through an electrically conductive spring 20.

In these embodiments, the protrusion 24 of the removable cartridge unit 22 is also electrically conductive. As both the contact member 14 and the protrusion 24 are electrically conductive, an electrical connection is established and maintained between the variable force biasing mechanism 10 and the removable cartridge unit 22 for as long as the cartridge unit 22 is operatively installed in the image forming apparatus.

For example, FIG. 1 depicts two variable force biasing mechanisms according to one embodiment of the present invention, that additionally serve as electrical connectors. In this embodiment, each electrical connector may supply a different voltage level connection to the removable cartridge unit, for example, a bias voltage and a ground. Alternatively, each electrical connector may provide the same voltage. Additional connectors may be provided, as necessary or desired, to accommodate the required electrical connections and/or bias force application requirements. Using the biasing mechanism 10 as an electrical contact not only decreases the cost of both the image forming apparatus and the removable cartridge unit 22 by avoiding the need for a separate electrical contact, but additionally affords greater control over the nip force generated and maintained by the biasing mechanism 10. Effective coupling of prior art electrical contacts for removable cartridge units 22 typically require a coupling force of 100-200 grams. Depending on the design and location of the contacts on the removable cartridge unit 22, this force may augment or counteract the nip force generated by the biasing mechanism 10, making precise control of the nip force more difficult. Furthermore, variations in the electrical contact mating force may introduce or exasperate hysteresis effects in the nip force generated by the biasing mechanism 10.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of controlling a force exerted on different removable cartridge units by an image forming apparatus, comprising:

providing at least one electrically conductive arm pivotally mounted in said image forming apparatus about a pivot point and biased by a force generating member into contact with a removable cartridge unit having at least one electrically conductive protrusion, said arm including a contact member having a longitudinal extent and wherein said protrusion contacts said arm along said contact member;

positioning a first protrusion on a first removable cartridge unit to contact said contact member at a first longitudinal position, said arm thereby exerting a first force on said first cartridge unit; and positioning a second protrusion on a second removable cartridge unit to contact said contact member at a second longitudinal position different from said first longitudinal position, said arm thereby exerting a second force on said second cartridge unit different from said first force.

2. The method of claim 1 wherein said first force is greater than said second force if said first protrusion on said first cartridge unit contacts said contact member at a position closer to said pivot point, when said first cartridge unit is mounted in said image forming apparatus, than said second protrusion on said second cartridge unit contacts said contact member, when said second cartridge unit is mounted in said image forming apparatus.

3. The method of claim 1 further comprising exerting said first force on said first removable cartridge unit and generating a first nip force between a developer roller on said first removable cartridge unit and a photoconductive drum and exerting said second force on said second removable cartridge unit and generating a second nip force between a developer roller on said second removable cartridge unit and said photoconductive drum with said first and second nip forces being different.

4. The method of claim 3 further comprising applying said first nip force along a common surface formed between said developer roller on said first removable cartridge unit and said photoconductive drum.

5. The method of claim 1 further comprising positioning said developer roller to extend outward from said first removable cartridge unit along a first side of said first removable cartridge unit and positioning said first protrusion on a second side opposite from said first side.

6. The method of claim 1 further comprising positioning said first protrusion to extend outward from a second side of said first removable cartridge unit a distance and said second protrusion to extend outward from a second side of said second removable cartridge unit said same distance.

7. The method of claim 1 further comprising attaching a wire to an electrical connection on said arm at an intermediate point adjacent to said pivot point and between first and second ends of said arm.

8. A method of controlling a force exerted on different removable cartridge units by an image forming apparatus, comprising:

positioning a first removable cartridge unit in said image forming apparatus;

applying a first force to said first removable cartridge unit through an electrically conductive arm pivotably mounted in said image forming apparatus, said arm biased with a force generating member to pivot about a pivot point;

positioning a first developer roller that extends outward from said first removable cartridge unit in contact with a photoconductive drum;

generating a first nip force between said first developer roller and said photoconductive drum;

replacing said first removable cartridge unit with a second removable cartridge unit;

applying a second force to said second removable cartridge unit through the electrically conductive arm;

positioning a second developer roller that extends outward from said second removable cartridge unit and in contact with said photoconductive drum; and generating a second different nip force between said second developer roller and said photoconductive drum.

9. The method of claim 8, further comprising forming an image with a first toner formulation when said first removable cartridge unit is mounted in said image forming apparatus, and forming an image with a second toner formulation when said second removable cartridge unit is mounted in said image forming apparatus.

10. The method of claim 8, wherein applying said first force to said first removable cartridge unit further comprises contacting a first electrically conductive protrusion on said first removable cartridge unit with said electrically conductive arm at a first distance away from said pivot point.

11. The method of claim 10, wherein applying said second force to said second removable cartridge unit further comprises contacting a second electrically conductive protrusion on said second removable cartridge unit with said electrically conductive arm at a second different distance away from said pivot point.

12. The method of claim 8 whereby providing said electrically conductive arm pivotally mounted in said image forming apparatus about said pivot point comprises positioning a first section of said electrically conductive arm that contacts said force generating member on a first side of said pivot point and positioning a second section of said electrically conductive arm that contacts said protrusions on a second side of said pivot point with said first and second sections giving said electrically conductive arm a substantially L shape.

13. The method of claim 8 further comprising contacting said electrically conductive arm at a point closer to said pivot point by said second electrically conductive protrusion than said first electrically conductive protrusion and exerting a greater force on said second removable cartridge unit than on said first removable cartridge unit.

14. The method of claim 8 further comprising positioning said first developer roller to extend outward from said first removable cartridge unit along a first side of said first removable cartridge unit and positioning said first protrusion on a second side opposite from said first side.

15. The method of claim 8 further comprising attaching a wire to an electrical connection on said electrically conductive arm at an intermediate point adjacent to said pivot point and between first and second ends of said electrically conductive arm.

16. A method of controlling a force exerted on different removable cartridge units by an image forming apparatus, comprising:

providing at least one electrically conductive arm pivotally mounted in said image forming apparatus about a pivot point and biased by a force generating member, said electrically conductive arm including a contact member;

attaching a wire to an electrical connection on said electrically conductive arm at an intermediate point adjacent to said pivot point and between first and second ends of said arm;

positioning a first protrusion on a first removable cartridge unit to contact said contact member at a first distance from said pivot point, said electrically conductive arm thereby exerting a first force on said first removable cartridge unit; and positioning a second protrusion on a second removable cartridge unit to contact said contact member at a second distance from said pivot point different from said first distance, said arm thereby exerting a second force on said second cartridge unit different from said first force.

17. The method of claim 16 wherein said first force is greater than said second force when said first distance is less than said second distance.

18. The method of claim 16 further comprising exerting said first force on said first cartridge unit and generating a first nip force between a developer roller on said first removable cartridge unit and a photoconductive drum in said image forming apparatus and exerting said second force on said second removable cartridge unit and generating a second nip force between a developer roller on said second removable cartridge unit and said photoconductive drum with said first and second nip forces being different.

19. The method of claim 18 further comprising applying said first force to said first removable cartridge unit and creating a uniform nip force along a common surface formed between said developer roller in said first cartridge unit and said photoconductive drum.

20. The method of claim 16 further comprising positioning a developer roller on said first removable cartridge unit to extend outward from a first side of said first removable cartridge unit and positioning said first protrusion on a second side opposite from said first side.

* * * * *